United States Patent [19]

Paulus et al.

[11] 4,350,434

[45] Sep. 21, 1982

[54] ELECTROPHOTOGRAPHIC COPYING MACHINE

[75] Inventors: Rudolf Paulus; Norbert Schankat, both of Munich; Manfred Weinzierl, Pfaffenhofen; Walter Franke, Bad Aibling, all of Fed. Rep. of Germany

[73] Assignee: Agfa-Gevaert Aktiengesellschaft, Leverkusen, Fed. Rep. of Germany

[21] Appl. No.: 948,325

[22] Filed: Oct. 4, 1978

[30] Foreign Application Priority Data

Oct. 19, 1977 [DE] Fed. Rep. of Germany ..... 2746991

[51] Int. Cl.[3] ..... G03G 15/00

[52] U.S. Cl. ..... 355/14 SH; 355/50

[58] Field of Search ..... 355/50, 51, 8, 14, 35 H, 355/72–74, 3 R, 14 R, 14 CU, 14 C, 14 SH, 14 E; 271/9

[56] References Cited

U.S. PATENT DOCUMENTS

| | | | |
|---|---|---|---|
| 3,622,238 | 11/1971 | Alman, Jr. et al. | 355/50 |
| 3,865,482 | 2/1975 | Bendall et al. | 355/14 |
| 3,900,258 | 8/1975 | Hoppner et al. | 355/8 X |
| 4,054,380 | 10/1977 | Donohue et al. | 355/14 |

*Primary Examiner*—L. T. Hix
*Assistant Examiner*—W. J. Brady
*Attorney, Agent, or Firm*—Michael J. Striker

[57] ABSTRACT

A copying machine has plural infeed capabilities, being provided for example with plural sheet supply units supplying sheets of different respective types or formats. A control panel is provided with a plurality of operator-activated dual-purpose select-and-start switches. When the operator activates one of these switches, this both selects the respective infeed capability and also commands initiation of copying, so that the operator need not thereafter press a second switch merely to initiate copying. The select-and-start switches are pushbutton switches the pushbuttons of which are translucent and provided, behind them, with respective signal lamps. During a copying operation, the signal lamp behind the one of the select-and-start switches which commanded copying lights up, to indicate that copying is occurring. If one of the supply units is exhausted, the respective signal lamp begins to blink, thereby indicating this to the operator. If the machine additionally has more than one mode of copying operation, e.g., a shifting optics scanning a stationary original and a transport unit transporting an original past a stationary optics, certain of the select-and-start switches can be additionally associated with these modes of copying operation, so that the user will not be able to select an infeed capability not appropriate for the selected mode of copying operation.

14 Claims, 2 Drawing Figures

1
2
3
4
5
6
7
8
9
10
11
12
13
14
15
18
19
21
22
23
24
25
26
27
28
28a
29
29a
30
30a
31
31a
32
33
33a
34
35
35a
36
37
37a
45
46
47
48
49

ELECTROPHOTOGRAPHIC COPYING MACHINE

BACKGROUND OF THE INVENTION

The present invention concerns copying machines, especially electrophotographic copying machines which produce finished copies on sheets of normal typing paper and have infeed capabilities for at least two different types of sheets. Such copying machines are provided with a selector switch for selecting the infeed capability to be utilized and a start switch which is used to initiate a copying operation per se.

Such machines are able to make copies not only on white typing paper but also on special papers, e.g., papers of special grade or color, sheets of differing format or sheets with a preprinted heading or text. With machines of this type it has always been necessary for the operator to set a selector switch to select the type of sheet to be printed (e.g., from plural feeding units each provided with a stack of sheets of a respective type) or to set the machine for a different sheet format, and then after that as a second step to press a start switch to initiate copying operation.

SUMMARY OF THE PRESENT INVENTION

It is one main object of the present invention to provide a copying machine with plural selectable infeed capabilities and having a control panel which is more easily monitored and operated than in comparable prior art, and furthermore of such a character as to inherently reduce the possibilities for inadvertent or mistaken actuation of operator controls.

According to the invention this is made possible by associating with each of the different infeed capabilities of the copying machine a respective selector switch which doubles as a start switch serving to initiate copying operation. Thus when the operator activates this switch, e.g., presses it if as preferred it is a pushbotton switch, he simultaneously selects which infeed capability the machine is to utilize and also commands the initiation of copying.

For example, the machine may have two or more supply stacks or supply magazines containing sheets of different respective types, in which case each supply stack or magazine or infeed unit can be provided with a respective selector button of its own which simultaneously serves as a start button.

According to a further concept of the invention, the control panel is additionally provided with a further dual purpose select-and-start switch, which the operator activates when individual-sheet infeed is to be manually performed.

Advantageously, each dual-purpose select and start button is provided with a signal lamp which is illuminated during copying operations commanded by depression of that button and which furthermore commences to blink when the stack of sheets in the respective supply stack or magazine becomes exhausted.

With this concept of the present invention, the operator need only activate a single switch or press a single button in order to both select the infeed capability which is to be used and also initiate copying operation. With the dual-purpose pushbutton furthermore lighting up during the course of a copying operation, e.g., to indicate termination of a copying operation and thus readiness of the machine for renewed activation, and also commencing to blink when the respective supply of sheets is becoming exhausted, this informs the operator of those prevailing conditions which are correlated with the type or format of sheet involved.

Another advantage of the invention resides in the case where a plurality of different sheet types and/or formats and also a plurality of differing modes of copying operation are to be selectable, but with certain modes of copying operation being naturally or optimally associated with certain sheet types or formats. For example, one of the infeed capabilities of the machine may be to feed in extra-long sheets of paper for continuous copying. In that event, depression of the pushbutton associated with strip infeed simultaneously serves to switch the machine over for continuous copying. Thus, in such situations, the inventive feature in question inherently minimizes the possibility that the operator will select a mode of copying operation not corresponding to the type or size of sheet which he has selected, or vice versa.

The dual-purpose select-and-start switch or button can command operation of the machine in the book-copying mode cooperating with a supply of normal paper or with a supply of special sheets, e.g., sheets of different color or provided with preimprinted headings or text, or can command operation in the book-copying mode with single-sheet manual infeed.

It is furthermore contemplated by the present invention to provide the control panel with additional switches or pushbuttons for the control of operating functions which are independent of the particular type of infeed capability selected, e.g., exposure-time corrections which depend upon the character of the original being copied. An auxiliary keyboard can be used for selecting the number of copies to be made per original, and a counter can indicate the number of copies selected and/or the number of copies remaining to be made.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
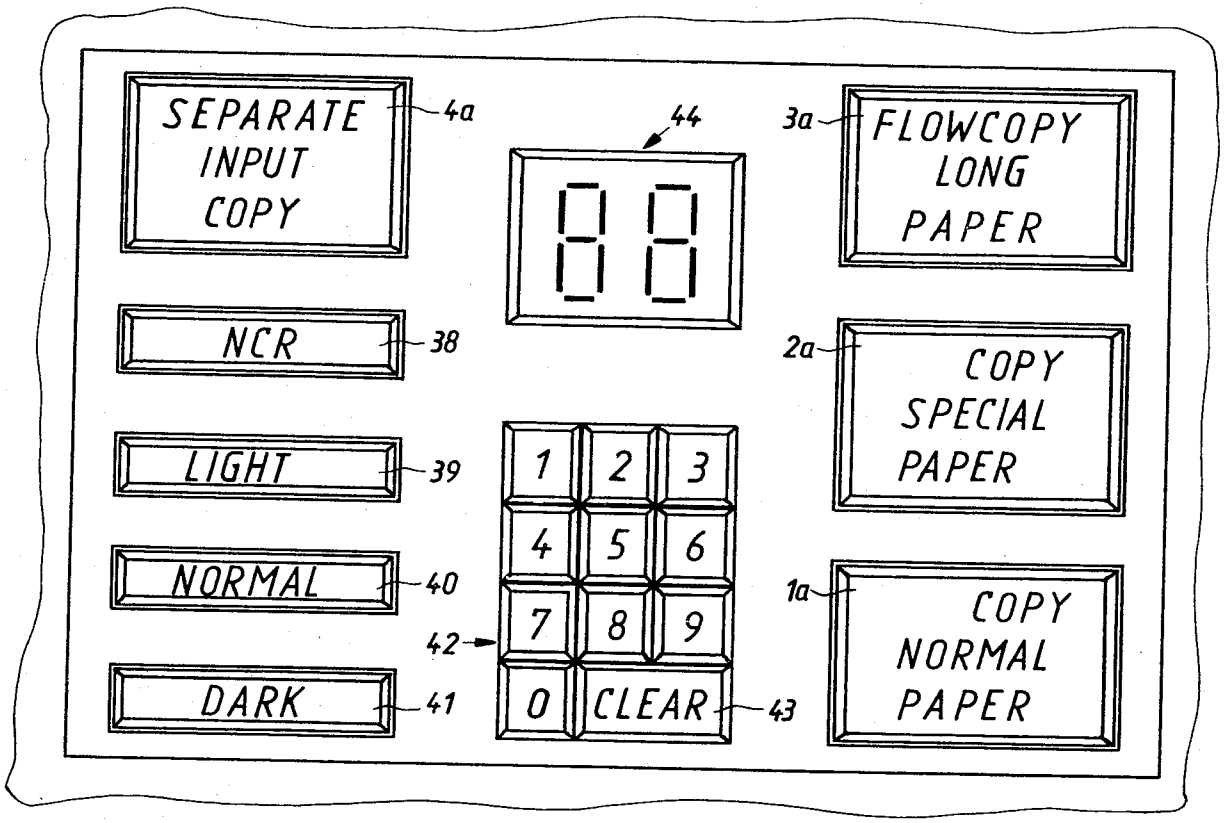
FIG. 1 depicts an operator control panel on a copying machine embodying the present invention.
Figure 2:
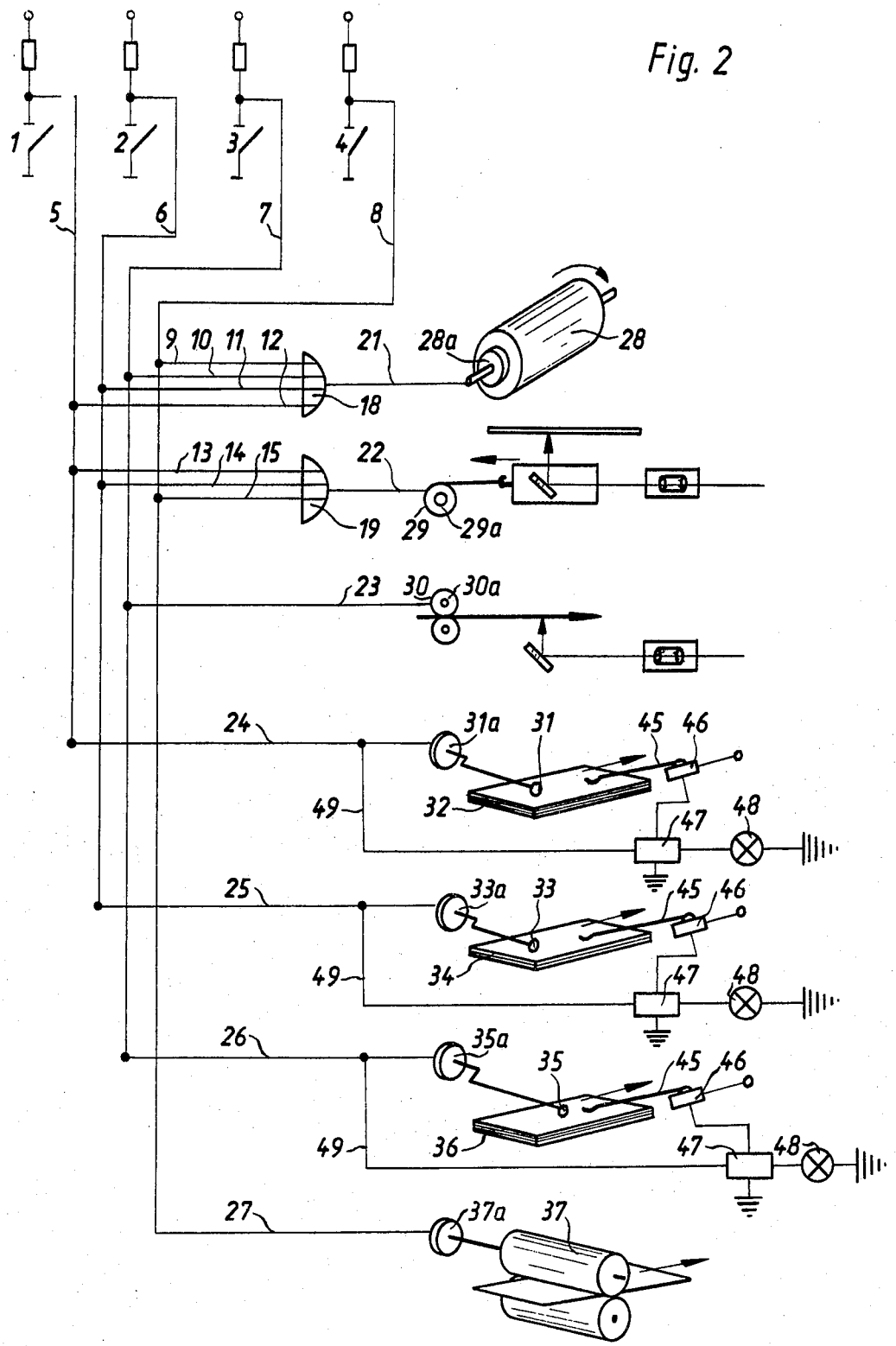
FIG. 2 is a simplified schematic block diagram depicting how various machine operations and functions are controlled in dependence upon activation of the pushbutton switches shown in FIG. 1.

FIG. 1 depicts a control panel provided with pushbuttons 1*a*–4*a* which activate control switches 1–4 in a copying machine control system schematically depicted in FIG. 2. The pushbuttons 1*a*–4*a* are used to close and open the respective control switches 1–4 and thereby apply signals to and remove them from respective ones of control lines 5–8. Control lines 5–8, directly via lines 23–27 or indirectly via connecting lines 9–15, OR-gates 18, 19 and lines 21 and 22, trigger various functional units of the electrophotographic copying machine.

In the very schematic depiction of FIG. 2, it is assumed for simplicity that the switches 1–4 directly switch the operating current flowing through lines 21–27. In actual practice, of course, control lines 5–8 will carry control signals which are applied to the windings of relays or driver stages, i.e., in order not to overload the switches 1–4 and the OR-gates 18 and 19.

Furthermore, in FIG. 2 it is assumed for simplicity that each symbolically represented functional unit of the machine is coupled via an electromagnetic coupling to a (non-illustrated) rotating component of the machine, in order to set such functional unit into operation. It will be understood, however, that the activating lines 21–27 could instead serve to activate relays, contactors, electric motors, or the like.

The functional units symbolically or schematically represented in FIG. 2 include the main control mechanism of the machine, represented by means of rotating copying drum 28 to which such main control mechanism is typically referenced. The rotating copying drum 28 is provided with a magnetic coupling 28*a* controlled via control line 21. The copying drum is to be understood to represent all those machine functions which are always performed in the same way irrespective of the selection of particular operating or infeed modes.

Control line 22 activates a magnetic coupling 29*a* for the carriage drive of an optical scanning carriage 29, of the type used in book-copying machines in libraries, wherein a stationary original to be copied is scanned by means of a shifted scanning mirror.

Reference numeral 30 denotes the transport roller pair used to transport copy paper for continuous-operation copying, wherein an original to be copied is transported past a non-moving projecting optics. The magnetic coupling 30*a*, by means of which this transport roller pair is coupled to the drive unit of the machine, is activated via control line 23.

Control line 24 activates the magnetic coupling 31*a* of a stroke-type sheet infeed unit 31 which engages the upper surface of the topmost sheet in a supply stack 32 containing normal white typing-paper sheets. Control line 25 activates the magnetic coupling 33*a* for a stroke-type sheet infeed unit 33 for a stack 34 of a special paper, and control line 26 activates the magnetic coupling 35*a* of a stroke-type infeed unit 35 for a stack 36 of extra-long paper.

Numeral 37 finally denotes a transport roller pair serving to feed in single sheets of paper fed to it by hand, and provided with a magnetic coupling 37*a* activated via control line 27.

The correlation between the dual-purpose select-and-start switches referred to above and the schematically illustrated functional units is as follows:

The magnetic coupling 28*a*, which is to be activated irrespective of the operator's particular selection, is connected via the OR-gate 18 and the branch-off lines 9–12 to all the control lines 5–8, and is accordingly activated irrespective of which one of pushbutton switches 1–4 the operator depresses. In contrast, the magnetic coupling 30*a* for the continuous-operation infeed unit 30, the magnetic couplings 31*a*, 33*a* and 35*a* for the differing supply stacks 32, 34 and 36, and the magnetic coupling 37*a* for the single-sheet infeed unit are each connected to only a respective one of the control lines 5–8.

Accordingly, when the COPY NORMAL PAPER pushbutton 1*a* is pressed, switch 1*a* is activated and accordingly control line 5. As a result, those machine functions which do not depend upon the particular selection are, as they should be, now commanded, and also the optical scanning arrangement 29 is commanded to scan the original, and the infeed unit 31 for normal paper is activated.

Depression of the COPY SPECIAL PAPER pushbutton 2*a* commands, via switch 2 and control line 6, activation of scanning unit 29 and of the infeed unit 33 for special paper. Accordingly, when this button is activated, a stationary original can be copied via a shifting optics onto special paper. I.e., with the machine operating in the book-copying mode, the machine can print onto sheets of special format or special grade or onto sheets which have been preprinted with headings or text.

Depression of the FLOWCOPY LONG PAPER pushbutton 3*a* commands, via switch 3 and control line 7, both the activation of the continuous-operation copying unit 30 and also activation of the infeed unit 35 for the special paper stack 36. This stack contains extra-long sheets, so that upon activation of this pushbutton especially long originals can be copied in a continuous-operation mode.

The SEPARATE INPUT COPY pushbutton 4 commands, via switch 4 and control line 8, activation of the infeed unit 37 for manual insertion of single sheets of copy paper and, by way of example, activation of the scanning arrangement 29 for a stationary original. The single sheets of copy paper are manually fed to infeed unit 37 through an infeed slot in the housing of the copying machine, for example. This mode of operation may be employed, for example, when copy sheets which have been printed on one side are to be reinserted for printing on their opposite sides. The copies emerging from the machine, and printed only on one side, are removed by the operator and manually inserted into infeed unit 37 for printing upon their other side, e.g., a second image from a second original.

The control panel shown in FIG. 1 is provided with further controls for machine functions whose performance does not depend upon the type or format of sheets selected or upon the type of copying operation associated with such selection. These further controls include pushbuttons 38–41 for selecting exposure duration, a keyboard 42 and a CLEAR button 43 for preselecting the number of copies to be made per original. The number of copies per original selected can be displayed on a counter 44, whose count decreases one-by-one during the ongoing performance of the selected number of copying operations, thereby indicating at any particular time the number of copies still to be made from a particular original.

Finally, as shown in FIG. 2, each of the three supply stacks 32, 34 and 36 is provided with a respective sensor 45 which activates an associated microswitch 46 when the respective stack of sheets is nearing exhaustion. The microswitches 46 activate respective blinkers 47, each of the latter being connected in the current path of a respective signal lamp 48. The pushbuttons 1*a*–3*a* are made of translucent material, and respective ones of the three signal lamps 48 are located behind them, e.g., in the manner disclosed in Federal Republic of Germany published patent application No. 2,021,408. The signal lamps 48 are connected to respective ones of control lines 5–7 via lines 49. Each signal lamp 48 is illuminated steadily so long as the respective control line is activated, e.g., during the making of copies on copy sheets of the selected type, but then starts to blink as the respective supply stack becomes exhausted.

It will be understood that each of the elements described above, or two or more together, may also find a useful application in other types of circuits and constructions differing from the types described above.

While the invention has been illustrated and described as embodied in a copying machine having particular infeed capabilities and correlated modes of copying operation, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a copying machine of the type having two or more infeed capabilities and control means activatable for implementing the respective infeed capabilities, an arrangement for selecting the infeed capability to be utilized, the arrangement comprising a plurality of operator-activated dual-purpose select-and-start switches each associated with a respective infeed capability and means responsive to activation of each operator-activated select-and-start switch for activating the respective control means and also initiating copying, whereby when the operator selects the infeed capability to be utilized he simultaneously commands initiation of copying and therefore need not activate a second switch merely to initiate copying.

2. The copying machine defined in claim 1, the copying machine being provided with a plurality of supply units supplying sheets of differing types, the operator-activated dual-purpose select-and-start switches including a plurality of such switches, one for each of the supply units, the means responsive to switch activation responding to activation of one of these select-and-start switches by activating the control means for the respective supply unit and also initiating copying.

3. The copying machine defined in claim 1, the copying machine including single-sheet infeed means receiving a manually inserted sheet, the plurality of operator-activated dual-purpose select-and-start switches including a select-and-start switch which when activated by the user causes the single-sheet infeed means to be activated and copying to be initiated.

4. The copying machine defined in claim 1, furthermore including a plurality of signal lamps, each located behind a respective select-and-start switch, the select-and-start switches provided with signal lamps being transparent, furthermore including means operative for illuminating the one of the signal lamps located behind the select-and-start switch which commanded the copying operation.

5. The copying machine defined in claim 4, the copying machine being provided with a plurality of supply units supplying sheets of differing types, the signal lamps being associated with respective ones of the supply units and furthermore including blinking means operative when the supply of sheets in a supply unit is exhausted for causing the respective signal lamp to blink.

6. The copying machine defined in claim 1, the copying machine including a shiftable projection optics for scanning a stationary original to form a copy therefrom and shifting means for shifting the projection optics, the copying machine furthermore including a plurality of supply units supplying sheets of different respective types including a normal sheet supply unit supplying sheets of predetermined type, one of the operator-activated dual-purpose select-and-start switches when activated activating the normal sheet supply unit and the shifting means.

7. The copying machine defined in claim 6, the supply units furthermore including a special sheet supply unit supplying sheets of a type different from the normal sheets, one of the operator-activated dual-purpose select-and-start switches when activated activating the special sheet supply unit and the shifting means.

8. The copying machine defined in claim 1, the copying machine including a shiftable projection optics for scanning a stationary original to form a copy therefrom and shifting means for shifting the projection optics, the copying machine furthermore including single-sheet infeed means for receiving a manually inserted sheet, one of the operator-activated dual-purpose select-and-start switches when activated activating the single-sheet infeed means and the shifting means.

9. The copying machine defined in claim 1, the copying machine including a stationary projection optics and transport means for transporting an original past the projection optics so as to be scanned by the latter, the copying machine also including sheet supply units supplying sheets of different respective types, including a normal sheet supply unit supplying sheets of one type and an extra-long sheet supply unit supplying sheets of extra length for continuous-operation copying, one of the operator-activated dual-purpose select-and-start switches when activated activating the transport means and the extra-long sheet supply unit.

10. The copying machine defined in claim 1, furthermore including selection-independent control means controlling copying machine functions which are independent of the particular infeed capability selected, and further operator-activated switches activated by the operator for controlling the operation of the selection-independent control means.

11. The copying machine defined in claim 10, the selection-independent control means including means controlling the duration of the copying exposure.

12. The copying machine defined in claim 1, furthermore including an auxiliary keyboard used by the operator for selecting the number of copies to be made per original.

13. The copying machine defined in claim 12, furthermore including a counter cooperating with the auxiliary keyboard and indicating the number of copies selected.

14. The copying machine defined in claim 12, furthermore including a counter cooperating with the auxiliary keyboard and indicating during repeated copying operations how many copies of a particular original remain to be made.

* * * * *